United States Patent [19]

Pajala et al.

[11] 3,942,902

[45] Mar. 9, 1976

[54] DEVICE FOR SPREADING MIXTURES OF PRIMARY COLORS IN FLUID FORM

[76] Inventors: Vieno Reino Pajala; Maija-Liisa Pajala, both of Toivolankatu 19A4, Turku, Finland

[22] Filed: Mar. 7, 1974

[21] Appl. No.: 448,923

[30] Foreign Application Priority Data

Mar. 8, 1973 Finland ..... 709/73

[52] U.S. Cl. ..... 401/45; 222/136; 222/144.5

[51] Int. Cl. ..... A46b 11/00

[58] Field of Search ..... 401/44–47, 401/34; 222/135, 136, 144.5, 145

[56] References Cited

UNITED STATES PATENTS

| | | | |
|---|---|---|---|
| 1,794,533 | 3/1931 | Niemtzow | 401/45 X |
| 2,130,978 | 9/1938 | White | 401/45 |
| 3,596,802 | 8/1971 | Feldman | 222/135 |
| 3,609,050 | 9/1971 | Vanderbilt | 401/190 |
| 3,807,880 | 4/1974 | Munz | 401/45 |

*Primary Examiner*—Lawrence Charles
*Attorney, Agent, or Firm*—Pravel & Wilson

[57] ABSTRACT

This invention relates to a method for spreading mixtures of primary colors in fluid form by means of a spreading device, such as a drawing or painting device, having containers for colors and thinner connected to a spreading or painting element.

35 Claims, 10 Drawing Figures

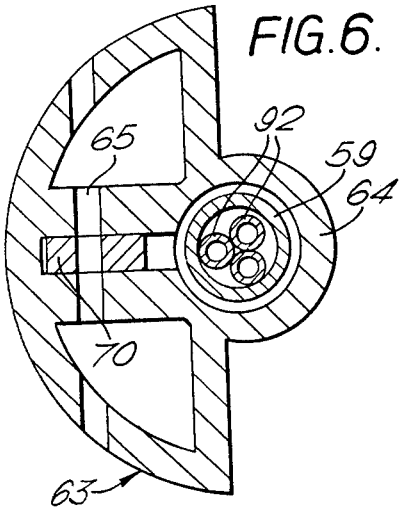
FIG. 6.
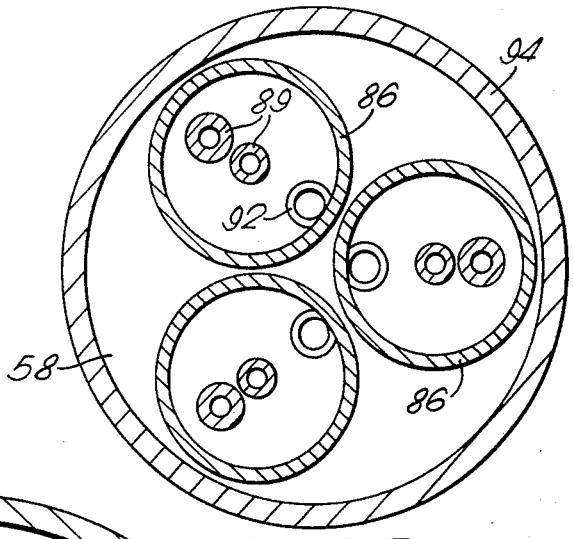
FIG. 7.
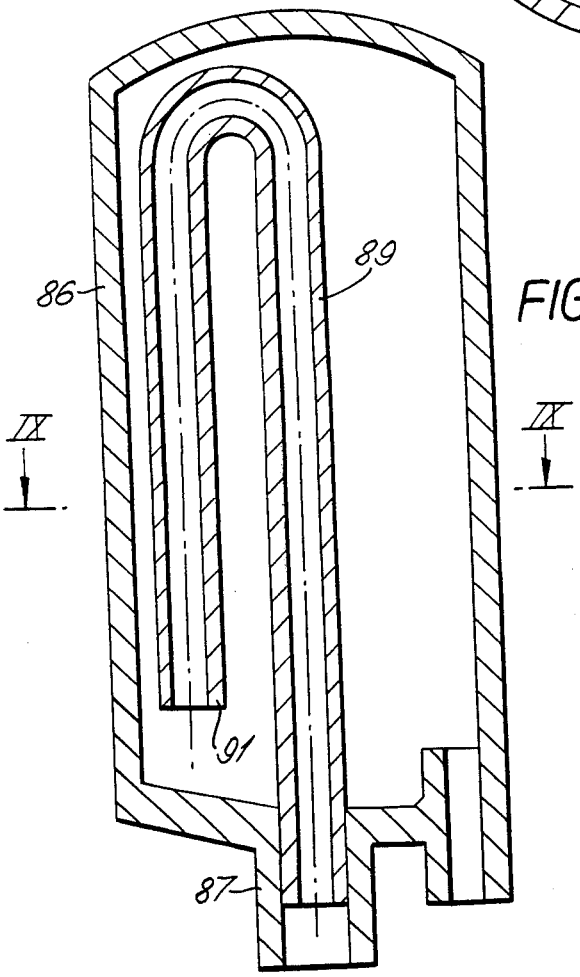
FIG. 8.
FIG. 9.
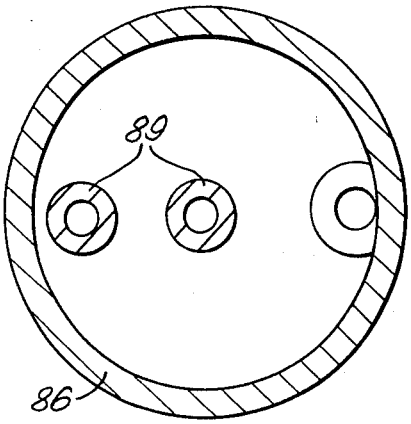

DEVICE FOR SPREADING MIXTURES OF PRIMARY COLORS IN FLUID FORM

The method according to the invention is mainly characterized in that two or more colors and possibly thinner are simultaneously fed from the respective containers under a suitable pressure in desired amounts to the spreading element and the ratio of the colors in the mixture, and thus the tone of the mixture, is changed by degrees or continuously during the spreading.

The main advantage of the method of the invention is the fact that a change from one color mixture and tone into another is achieved by degrees or continuously very fast while it is not necessary to lift the painting element off the spreading base at all.

The invention also relates to a spreading device for carrying out the above method, the characteristics of the device are set forth in the claims.

According to one main characterizing feature of the invention, a guide sleeve of a setting sleeve with pressing balls is movable by means of a pressing lever provided with a pressing arm, the pressing lever being pivotally connected to the guide sleeve, and the said push arm being pivotally mounted to the pressing lever, and the pressing lever is provided with teeth acting together with a setting ratchet and a setting arm so that the support point of the pressing lever can be changed by means of the setting ratchet so that when the pressing arm is pressed either the setting sleeve or the push arm or both are moving.

Color in fluid form in this specification means liquid which itself is coloring agent as or into which coloring agent, in pigments or otherwise mixed, is dissolved or suspended.

Figure 1:
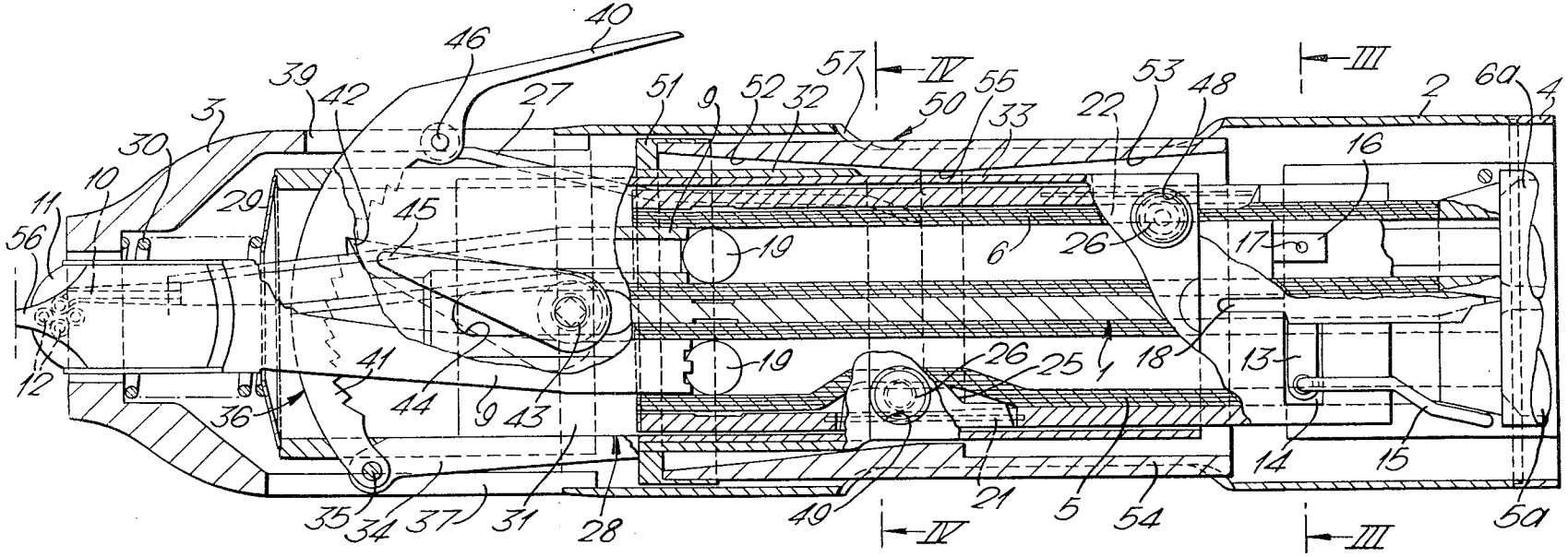
Figure 2:
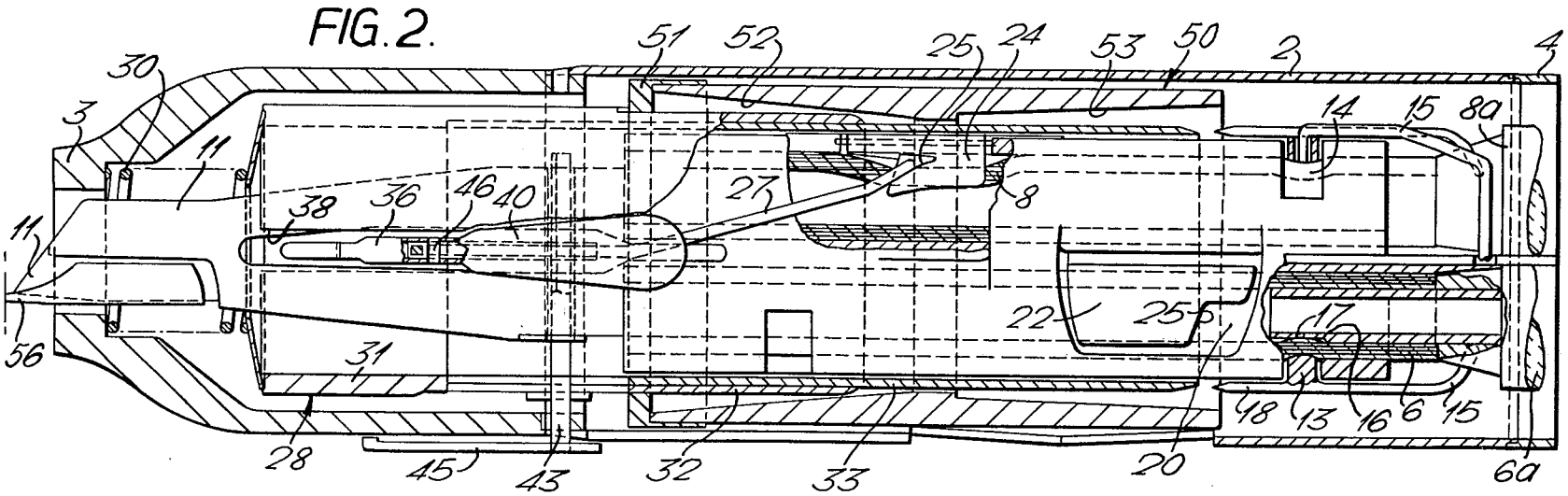
Figure 3:
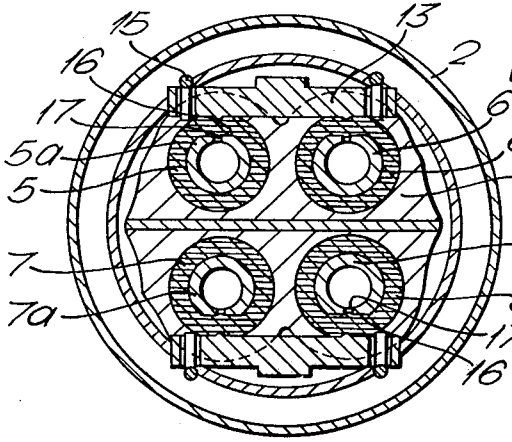
Figure 4:
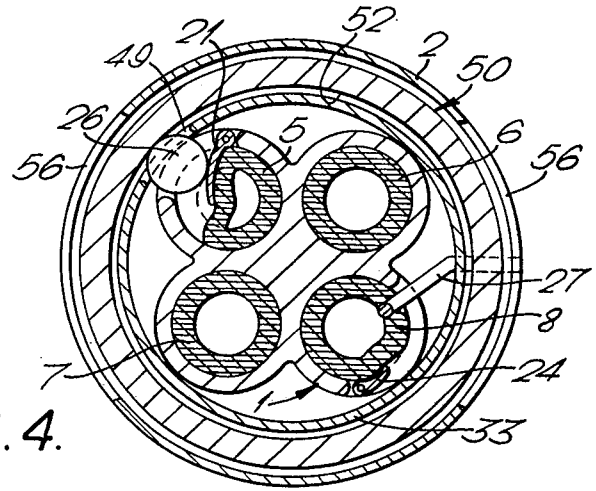
Figure 5:
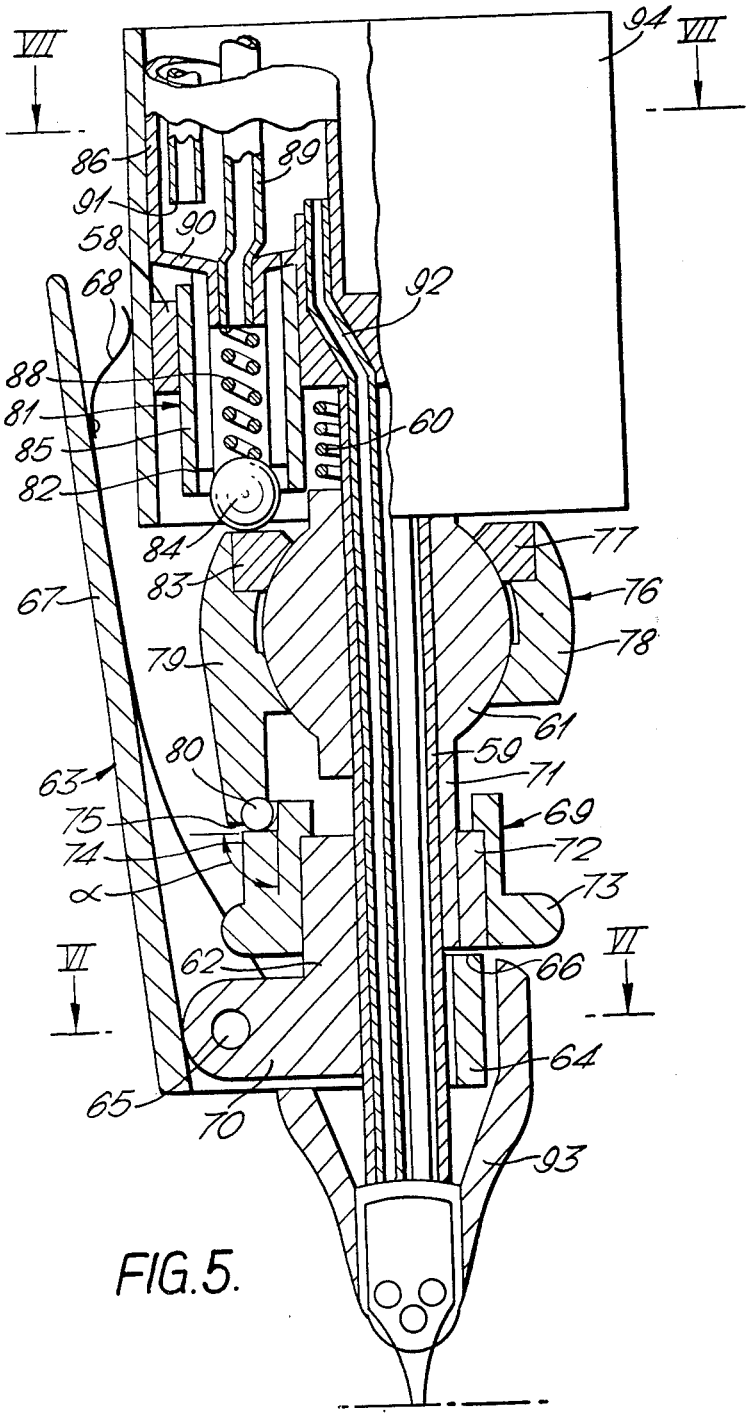
Figure 10:
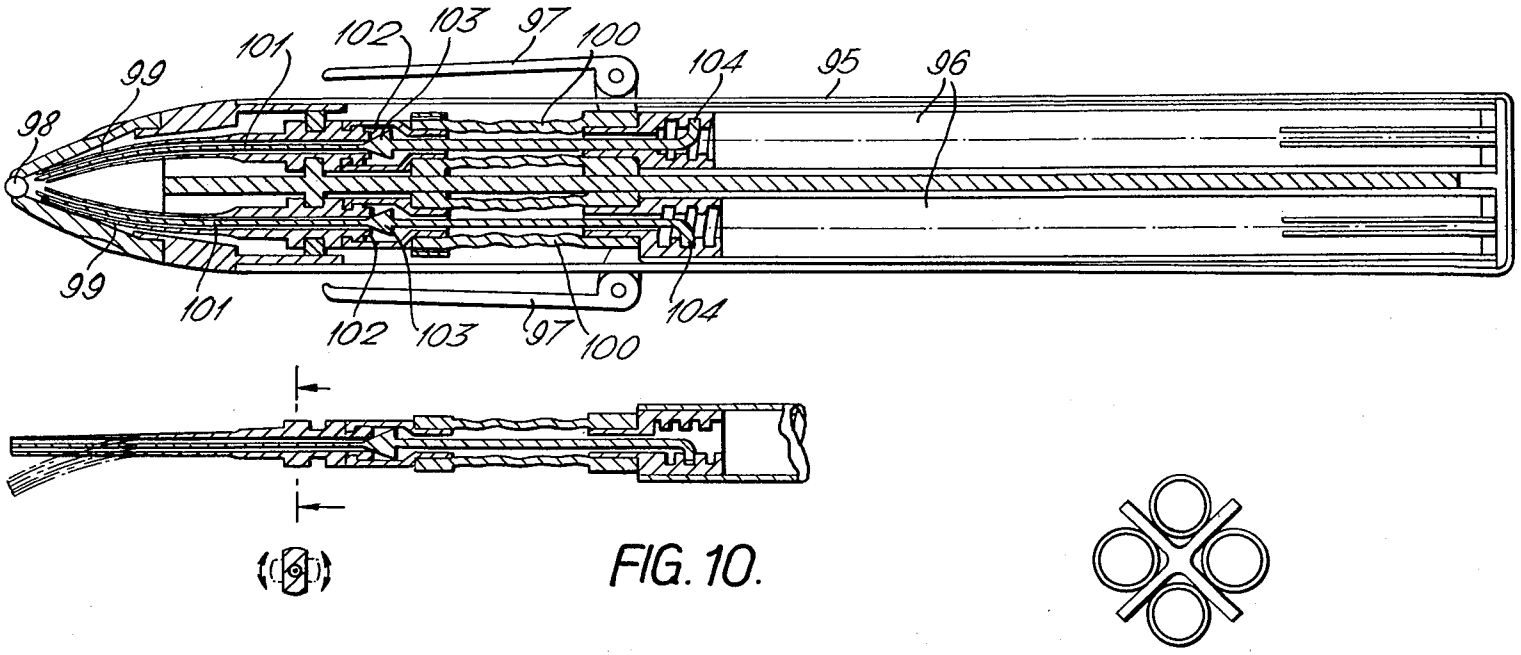

The method of the invention, and the device will be further described with reference to the accompanying drawings, in which FIG. 1 shows a longitudinal view of one embodiment of the device according to the invention, in the form of a pen, where the upper part is not shown, partially in section, FIG. 2 shows similarly a longitudinal view, the section being taken perpendicularly to the view of FIG. 1, FIGS. 3 and 4 show cross sections taken on lines III—III and IV—IV of FIG. 1, FIG. 5 shows a longitudinal view of another embodiment of the device according to the invention, where the upper part is not shown, partially in section, FIGS. 6 and 7 show cross sections taken on lines VI—VI and VII—VII of FIG. 5, FIG. 8 shows a sectional side view of one single container of the device of FIG. 5, FIG. 9 shows a cross section taken on line IX—IX of FIG. 8, and FIG. 10 shows a longitudinal sectional view of still another embodiment of the invention.

In the following specification, the lower or front end of the device means the end provided with a spreading element, and the upper or rear end means the opposite end of the device.

The embodiment shown in FIGS. 1 to 4 has a frame 1, arranged coaxially inside a sleevelike outer casing comprising a protecting sleeve 2, a protecting point 3 at the lower end of the protecting sleeve, and an upper protecting sleeve 4 connected to the upper end of the protecting sleeve 2. The upper end of the upper protecting sleeve 4 can be provided with a button for a cleaning device for the color discharge openings. Tubular, longitudinal containers for color and thinner, made of plastic material, for instance, are fitted in the upper end of the frame 1. Each two containers are arranged adjacent to each other and on top of each other. Seen from the upper end, a container **5*a* for blue color is on top on the left, a container 6*a* for yellow color is next to it on the right, a container 7*a* for red color is below the container 5*a*, and container 8*a* for thinner is next to the container 7*a*. The lower end of each container is connected with an adjustment cavity formed by a tube of elastic material. The container 5*a* for blue color continues as an adjustment cavity 5, the container 6*a* for yellow color continues as an adjustment cavity 6, the container 7*a* for red color continues as an adjustment cavity 7, and the container 8*a* for thinner continues as an adjustment cavity 8. These adjustment cavities continue as tubes 9 attached to the lower end of the frame 1, and then as ducts 10 through a duct support sleeve 11 attached to the tubes 9, and open into discharge openings 12 in the upper surface of the sleeve 11. In the embodiment shown, the discharge openings 12** are arranged so that an opening for blue color is furthest in the point, openings for red and yellow colors are next to each other behind it, and an opening for thinner is at the rear.

Back pressure valves, each comprising a common transverse valve piece 13 for each pair of adjacent adjustment cavities 5, 6 and 7, 8, are arranged at the upper ends of the adjustment cavities 5 to 8. These valve pieces are in contact with the outer surfaces of the adjustment cavities through openings 14 in the frame. The ends of two bow springs 15 are connected to the adjacent ends of the valve pieces 13 on the opposite sides. The lower end of each container is closed and extends into the upper end of an adjustment cavity and has a flat section 16. At this point, there is a hole 17 in the wall of the container. When the back pressure valves are closed, the bow springs 15 press the valve pieces 13 against the said flat sections 16 of the adjustment cavities, and the holes 17 are closed. In order to open the back pressure valves, each valve piece 13 is provided with an opening projection 18, the functioning of which will be described later.

A ball 19 forming a ball valve is arranged at the lower end of each elastic adjustment cavity 5 to 8, at an opening or dent in the frame 1. The diameter of the ball 19 is such that when the ball valve is closed, the ball shuts the lower end of the adjustment cavity, but when the pressure in the adjustment cavity increases, fluid in the cavity runs between the ball and the inner surface of the adjustment cavity through the corresponding tube 9 and duct 11 into the respective discharge opening 12, as will be described later. At each adjustment cavity 5 to 8 there is a longitudinal opening 20 in the frame 1 so that each adjustment cavity can be seen. Two of these openings, the opening at the adjustment cavity 6 for yellow color and the opening at the adjustment cavity 7 are positioned at the upper end of the adjustment cavities, at the same level. The opening at the adjustment cavity 5 for blue color is positioned at the lower end of the cavity, and the opening at the adjustment cavity 8 for thinner is positioned approximately in the middle of the adjustment cavity. A pumping or pressing wedge is mounted to the frame 1 at one longitudinal edge of the opening of each adjustment cavity 5 to 8 so that it pivots around the longitudinal axle of the adjustment cavity. Reference number 21 denotes the wedge for blue color, 22 for yellow, 23 for red, and 24 for thinner. The wedges 21 to 23 for color adjustment cavities are similar to each other and each comprises a plate with a hollow bottom surface, i.e. the surface in contact with the adjustment cavity. The upper end of the plate is narrower than the rest of the plate and it becomes thicker in a wedgelike manner towards the front. A sloping surface 25 is formed at the joining section of the narrower and broader sections. A pressing ball 26 acts together with each pressing wedge, the purpose and arrangement of these balls will be described later. These pressing balls are referred to in the following way:

the pressing ball at the adjustment cavity 5 or at the pressing wedge 21 for blue color is called the pressing ball 26 of blue color, the pressing ball at the adjustment cavity or at the pressing wedge for red color is called the pressing ball 26 of red color, and so on. The pressing wedge 24 for thinner is substantially similar to the others, but its narrower end and thus its sloping surface 25 is directed towards the front, i.e. towards the point of the device, and this pressing wedge is operated by a push arm 27 which will be described later. Following is a description of the elements which operate the pressing wedges by means of the pressing balls 26 and the push arm 27 in order to pump colors or thinner through the discharge openings 12.

One of these elements is a guide a sleeve 28 for moving the pressing balls 26 and the pressing wedges. In FIGS. 1 and 2 this sleeve is shown close to its front position. A spiral spring 30 is arranged between a counter plate 29 at the front end of the guide sleeve 28 and a shoulder in the inner surface of a point cover 3. This spring tends to keep the guide sleeve at its rear position. The guide sleeve 28 comprises a wider front section 31, a thinner cylindrical section 32 behind the front section, and a rear section 33 fitted inside the section 32. A curved pressing lever 36 is mounted to brackets 34 fitted on one side of the front section 31 of the guide sleeve so that it pivots around a transverse pin 35 and this end can move in a longitudinal slot 37 in the point cover 3. The pressing lever 36 extends between the tubes 9 and through a longitudinal slot 38 at the front end of the guide sleeve 28 and through a similar slot 39 in the point cover 3 and then extends towards the rear forming an arm 40. The inner side of the curved section of the pressing lever 36 is provided with teeth 41, as can be seen in FIG. 1. One end of a setting ratchet 42 is in contact with these teeth. The setting ratchet 42 is rigidly mounted to a transverse shaft 43 which is rotatably mounted to a longitudinal slot 44 in the front section 31 of the guide sleeve 28. A setting arm 45 for setting the torque ratio of the pressing lever 36 is mounted to the other end of the shaft 43 extending through the point cover 3. The setting arm 45 is parallel to the setting ratchet 42 and so the position of the setting arm 45 shows also the position of the setting ratchet 42 and the position were the setting ratchet 42 contacts the teeth 41, that is the support point of the pressing arm. One end of the said push arm 27 is mounted opposite to the pivot point 35 of the pressing lever 36, approximately at the slot 39 of the point cover 3, so that the push arm pivots around a transverse shaft 46. The other end of the push arm operates together with the pressing wedge 24 of the adjustment cavity for thinner. Depending on the point where the setting ratchet 42 is in contact with the teeth 41, the pressing lever 36 acts either as an one-armed or two-armed lever. In the first case, when the setting ratchet 42 contacts the teeth at the uppermost notch in FIG. 1, that is the notch next to the pivot point 46 of the push arm 27, the lever arm is at its longest. When the pressing arm 40 is now pressed towards the outer casing to the extreme position, the pressing lever moves the guide sleeve 28 the longest distance towards the front or the point against the spiral spring 30, while the pivot point 46 and the push arm 27 remain substantially stationary. On the other hand, when the setting ratchet 42 has been brought to contact with the teeth at the lowest notch in FIG. 1, that is the notch next to the pivot point 35 of the pressing lever, by turning the setting arm 45, and when the pressing arm 40 is pressed towards the outer casing, the push arm 27 moves towards the rear and the guide sleeve remains stationary. The results of these operations will be further described later in connection with the functioning of the device.

The rear section 33 of the guide sleeve 28 is provided with two opposite near the rear end of the rear section. One hole is at the adjustment cavity 7 for red colors, and the other hole 48 is at the adjustment cavity 6 for yellow colors. The guide sleeve is further provided with a third hole 49 which is positioned at the adjustment cavity 5 for blue colors and at a distance equal to half the length of the guide sleeve 28 from the corresponding holes of red and yellow colors, between these two holes when seen in the longitudinal direction. One pressing ball 26 is fitted in each hole. The setting sleeve 50 which will be described below, prevents the balls from escaping the respective holes.

A guide ring 51 is mounted around the front end of the setting sleeve 50. When the setting sleeve is in its front position, the guide ring rests against the shoulder between the front section 31 of the guide sleeve 28 and the guide surface 32. The rear end of the guide ring extends behind the rear end of the guide sleeve. The guide ring 51 of the guide sleeve 50 is fitted in a known way onto the guide surface 32 of the guide sleeve so that the setting sleeve 50 can be moved in the longitudinal direction and turned around the guide surface 32 by hand or by fingers. However, the fitting must be such that the setting sleeve cannot move by itself in relation to the guide sleeve 28 and that it moves together with the guide sleeve 28 in the longitudinal direction.

The color setting element which in this embodiment is the setting sleeve 50 comprises a cylindrical sleeve having inside its front section a conical surface. This conical surface comprises a cut, right cone with a circular bottom and will be called the right cone surface 52. The rear section of the setting sleeve 50 is also provided with a conical surface which will be called the oblique cone surface 53. This surface comprises a cut, oblique cone converging towards the front. The line 54 of this cone in FIG. 1, called the neutral line, is parallel to the axle of the setting sleeve 50, and the oblique cone surface 53 extends to both sides of the line 54. Between the right cone surface 52 and the oblique cone surface 53 there is a short cylindrical surface 55 which acts as a guide surface for the setting sleeve on the rear section 33 of the guide sleeve 28.

The spreading device described above is provided with a spreading element, such as a pen point 56 (FIGS. 1 and 2), ball point, brush or the like, which is connected to the discharge openings 12 of the ducts 10 and can be fitted between the support sleeve 11 and the point cover 3.

As the three primary color, red, yellow and blue, the method and device according to the invention uses color agents where surface active agents have been added so that the color are easily completely mixed. Alifatic alcohols, aldehydes, ketones, carbonic and sulfonic acids and the like can be used as surface active agents. The method of the invention and the functioning of the device will be further described below in connection with some embodiments. First will be described the initial positions of the elements where the elements are when the spreading device is not used. This state, however, is not shown in the drawings. In the initial position, the spring 30 has pressed the guide sleeve 28 into its rear position where the guide sleeve has opened the back pressure valves because the rear end of the guide sleeve 28 has raised the valve pieces 13 by means of the opening projection 18 so that the valve pieces do not shut the holes 17 by means of the adjustment cavities. Color agents and thinner run now from the containers 5*a* – 8*a* to the respective adjustment cavities 5 to 8. The front ends of the adjustment cavities, however, are closed by the balls 19. It is assumed that the setting sleeve 50 is at its front position and turned into a position where the said neutral line 54 of the oblique cone surface 53 is at its lowest position. In this position, all the pressing balls 26 are in the notches formed by the slanted surfaces 25 of the pressing wedges and the openings 20 so that they rest freely against the corresponding elastic adjustment cavities. The adjustment ball 26 for blue color is now at the narrow section of the right cone surface 52, in contact with this cone surface, and the pressing balls 26 for red and yellow color are nearly at the widest section of the oblique cone surface 53, and the rear end of the push arm 27 is at the front end of the slanted surface of the pressing wedge 24. The setting ratchet 42 can have any position. If it is desired to obtain blue color only, thinned with a small amount of thinner, while the setting sleeve 50 is in the position described above, the setting ratchet 42 is brought into contact with the teeth of the pressing lever 36 at a notch above the center in FIG. 1, by means of the setting arm 45. When the pressing arm 40 is pressed towards the outer casing, the setting sleeve 50 and all the pressing balls 26 start moving with the guide sleeve 28 forwards and the push arm 27 starts moving backwards. The rear edge of the guide sleeve 28 escapes from below the opening projections 18 of the back pressure valves so that the bow springs 15 press the valve pieces 13 against the adjustment cavities, and the back pressure valves are closed. When the pressing arm 40 is pressed further, the guide sleeve 28 moves the pressing ball 26 along the sloping surface 25 of the pressing wedge 21 onto the pressing wedge and forward along its wedge surface. As the setting sleeve 50 also moves forward, its right cone surface 52 gradually forces the pressing wedge 21 to press a dent into the adjustment cavity 5 by means of the setting ball for blue color, so that pressure increases in this adjustment cavity. As the back pressure valves are closed, fluid flows between the ball 19 of the ball valve and the elastic wall of the adjustment cavity into the tube 9 and then through the duct 10 out from the discharge opening 12. Simultaneously, the rear end of the push arm 27 has risen along the sloping surface of the pressing wedge 24 onto the wedge surface so that the pressing wedge 24 presses a dent into the elastic adjustment cavity 8 for thinner, and thinner flows from its discharge opening 12 in the same way as blue color. Blue color and thinner flow until the guide sleeve 28 and the setting sleeve 50 have reached their front positions and the pressing ball 26 for blue color has nearly reached the thickest section of its pressing wedge 21 and the rear end of the push arm 27 for thinner has risen a short distance along the sloping surface of the pressing wedge 24 onto the wedge surface. This state is shown in the drawings. When the pressing arm 40 is now released, the spring 30 causes the parts to return to their initial positions, and after this the above operations are repeated when the pressing arm is pressed. If a lighter tone of blue is desired, that is more thinner is required, the support point of the pressing lever 36 is changed closer to the pivot point 35 of the pressing lever by means of the setting arm 45 and the setting ratchet 42, and the push arm 27 for thinner is pushed further onto its pressing wedge 24 and the pressing ball for blue color will not reach the thickest point of its pressing wedge 21. When the support point of the pressing lever is at its furthest point from the pivot point 34 of the pressing lever 36, blue color only is obtained. If the support point of the pressing lever 36 is moved closer to the pivot point 35 of the pressing lever, only thinner flows from its discharge opening, and the spreading element can be washed with thinner.

Next will be described a case where a mixture of red and yellow colors is desired from the spreading element. For this purpose, the setting sleeve 50 is moved rearwards to its extreme position so that the setting ball 26 for red color and the setting ball 26 for yellow color, positioned diamethically to the former, will be positioned at the narrowest point of the oblique cone surface 53, and the setting ball 26 for blue color will be positioned at the wider end of the right cone surface 52 of the setting sleeve 50. The ratio between red and yellow colors, that is the tone, is adjusted by turning the setting sleeve 50 around its guide surface. In order to move the setting sleeve in the longitudinal direction and to turn the setting sleeve, the outer casing is provided with two diametral openings 57 at the location of the setting sleeve, and the setting sleeve can be moved through these openings by means of two fingers. The mixture will have more of that color which has a smaller distance between the pressing ball 26 and the oblique cone surface 53. However, the volume flowing out from the spreading device will always be the same, even if the ratio between yellow and red colors will change. The mixture will be caused to flow by pressing the pressing arm 40 in the manner described above so that the support point of the pressing lever 36 is adjusted on the teeth 41 to the notch furthest from the pivot point 35 of the pressing lever.

By turning the setting sleeve 50, the ratio between yellow and red colors, that is the tone, can be changed while the device is used for spreading. If the setting sleeve 50 is turned so that its neutral line will be either at the pressing ball of the red color or at the pressing ball of the yellow color, correspondingly either only red or only yellow color will flow from the spreading element. In case a thinner mixture with a set tone is desired, this can be achieved by changing the support point of the pressing lever 36 further from the pivot point 46 of the push arm 27. If this support point is in the middle of the teeth 41 of the pressing lever 36, the amount of thinner will be equal to the total amount of red and yellow colors, whatever the ratio between these two colors may be.

Next will be described a case where a mixture of blue and yellow or blue and red is desired. To achieve this, the setting sleeve 50 is moved longitudinally to a position where the pressing ball 26 for blue color is between the narrowest and widest sections of the right cone surface 52, and correspondingly the pressing balls 26 for yellow and red colors are between the narrowest and widest sections of the oblique cone surface 53. If a mixture of blue and red is desired, the setting sleeve 50 is turned so that the neutral line 54 of the oblique cone surface is at the setting ball 26 for yellow color, and if a mixture of blue and yellow is desired, the line 54 of the oblique cone surface 53 is turned to the pressing ball for red color. The tone of the color can be changed by adjusting the setting sleeve 50 longitudinally between its extreme positions in the front and the rear. The adjustment of thinner is achieved by changing the support point of the pressing lever 36 in the manner described above.

Next will be described a case where a mixture of all the three primary colors, that is red, yellow and blue, and possibly thinner, flows from the spreading element. The setting sleeve 50 is adjusted longitudinally as described above so that the ratio between blue color and the total amount of red and yellow colors is defined. The ratio between red and yellow colors is defined by turning the setting sleeve 50. The volume flow of red or yellow colors will depend on the positions of the respective pressing balls on the oblique cone surface 53. The adjustment of the flow of thinner will be done as described above, by changing the support point of the pressing lever in the teeth 41.

As can be seen from the above, a mixture of blue and either red or yellow will be obtained by moving the setting sleeve 50 between its extreme front and rear positions so that by turning the setting sleeve, its neutral line 54 is brought correspondingly to the pressing ball 26 of either yellow or red color. In order to achieve a mixture of all the three colors, the setting sleeve 50 is turned besides the longitudinal movement so that the pressing balls for red or yellow colors is not at the neutral line of the oblique cone surface 53. In this way, the consistency and the tone of the color mixture can be continuously changed when spreading the mixture. The flow and volume of thinner is adjusted by means of the pressing lever 36 and the setting ratchet 27.

The slopes of the right cone surface 52 and the oblique cone surface 53 of the setting sleeve 50 are such that whatever number of colors and thinner is led to the spreading element, the total volume flow outwards is always the same. If a mixture of all the three primary colors is spread, an increase in yellow or red color will decrease the amount of blue color, whatever the ratio between yellow and red color is. If thinner is included, this will decrease the amount of all the other colors while the total volume flow from the discharge openings is always the same.

In order to find the position of the neutral line 54 on the setting sleeve 50, the position has been marked on the setting sleeve 50. In case the setting sleeve is made of transparent material, this mark is unnecessary. Further, the setting sleeve 50 can be provided with a color chart, and the cover sleeve 2 of the middle section can be provided with an opening where the desired color or colors can be seen when moving the setting sleeve.

FIGS. 5 to 9 show another embodiment of the spreading device for carrying out the method of the invention. This device has a frame plate 58 and a center tube 59 connected to each other. A spiral spring 60 is fitted around the tube 59. A setting ball 61 is fitted around the tube 59 and can be moved in direction of the tube 59, against the spring force of the spring 60. A sleevelike part 62 is rigidly mounted around the center tube 59, below the setting ball 61. A setting lever 63 is pivotally mounted to brackets 70 of the sleevelike part 62, by means of a pin 65. The setting lever 63 comprises a ring section 64 around the center tube 59, and a turning arm 67, provided with a return spring 68. A setting rod 71 extending in a groove 72 through sleeve 62 is fitted next to the center tube 59, between the setting ball 61 and the upper surface 66 of the ring section 64.

A counter sleeve 69 is turnably mounted around the sleeve 62. The counter sleeve comprises a turn shoulder 73 in the lower part, and a counter section 74 extending upwards. In the position shown in FIG. 5, the maximum section of a cone section of the sleeve 69 can be seen as a step surface 75 of the counter section 74. In this maximum section the surface 75 forms an angle $\alpha$ of 90° with the sleeve surface. The angle $\alpha$ of the counter section 74 decreases continuously in both directions around the sleeve 69, and on the opposite side of the sleeve the angle is 0°, as can be seen from FIG. 5; that is, the counter section merges with the outer surface of the sleeve in this minimum section. When turning the sleeve 69 from the minimum section 0° to the maximum section 180° and further again to the minimum section 0° (= 360°), the counter angle $\alpha$ changes preferably continuously and linearly and it can have the following sizes in different sections, for instance:

| Turning angle | Counter angle ($\alpha$) |
|---|---|
| 0° | 0° |
| 45° | 22.5° |
| 90° | 45° |
| 135° | 67.5° |
| 180° | 90° |
| 225° | 67.5° |
| 270° | 45° |
| 315° | 22.5° |
| 360° | 0° |

A cover section 76 comprising two halves, 77 and 78, is fitted on the setting ball 61. An extension 79 extends downwards from the lower half 78, and a ball 80 is fitted to its lower part. The ball 80 moves against the surface 75 of the counter section 74 of the counter sleeve 69, when adjustments are done along the surface 75.

Three setting valves 81 are mounted symmetrically in the circular frame plate 58, at a distance of 120° from each other. The opening of the setting valves 81 is adjusted by means of the movements of the setting ball 61 and the cover section 76. The valves 81 are formed for instance by tube guides 82 each having a ball 84 fitted to the lower end, on the upper surface 83 of the cover section 76. When the ball 84 is moved upwards, it meets a sealing part 85, made of some resilient material. A color container 86 is mounted at the upper end of each valve 81. A spiral spring 88 is fitted between a neck 87 in the lower part of the color container and the ball 84. This spring presses the ball 84 against the surface 83 and tends to open the valve 81. A thin capillary tube 89 is fitted inside each longitudinal color container 86. The capillary tube 89 is fitted inside the neck section 87 of the color container 86 in such a way that the air flow into the capillary tube 89, and the air pressure can be adjusted by means of the valve 81. The capillary tube 89 starts directly from the valve 81, extends to the upper part of the color container where it forms an U-bend and then returns to the lower part of the container 86 near the bottom 90 of the container 86, where the end 91 of the tube 89 opens into direct connection with the inside of the container 86. A discharge tube or pipe 92 runs from the edge of the bottom 91 of the container 86 through the inner part of the center tube 59 down into a casing point 93, connected to the lower part of the center tube, and further into spreading element in the point. The spreading element can be similar to the one descirbed in connection with the first embodiment. A sleevelike outer casing 94 which can be attached for instance to the frame plate 58 is fitted around the containers 86 and forms the handle of the spreading device.

Following is a description of the functioning of the device as regards the color containers. The device has three color containers 86, each filled with a primary color. Red, blue and yellow colors are also in this case preferably liquids where surface active agent has been added. The color containers 86 are directly connected with the point of the spreading device by means of the tube or pipe 92. When the valve 81 is closed, color from the corresponding container cannot flow. When the valve 81 is opened, air flows past the ball 84 and air pressure enters the capillary tube 89 and further the container 86. Color from the container 86 flows now through the tube 92 into the point of the spreading device.

If only one primary color is desired from the device, following procedure is followed. The minimum section of the counter sleeve 69 is turned to the setting valve 81 of the corresponding color container 86, and then the cover section 76 is turned until the ball 80 is at the maximum section of the counter sleeve 69. When the turning arm 67 is now pressed against the spring 68, the ring section 64 of the setting arm 63 moves downwards, towards the point of the spreading device. The setting ball 61 resting through the setting arm 71 against the upper surface 66 of the ring section 64 will move correspondingly downwards pushed by the spring 60. The setting ball 61 will also move the cover section 76. As the cover section 76 is in contact with the counter surface 75 of the counter sleeve 69 by means of the arm 79 and the ball 80, the downwards movement of the setting ball forces by means of the arm 79 the cover section 76 to turn. The ball 80 rolls a short distance along the surface 75 outwards in the direction of the radius of the sleeve 69. The tilting of the cover section 76 will cause the valve 81 of the color container 86 at the minimum section of the counter sleeve 69 to open, and color in question will flow to the point of the spreading device. The valves 81 of the other two color containers 86 will remain closed.

When a mixture of two primary colors is desired, the maximum section of the counter sleeve 69 is set to the setting valve 81 of that color which is not desired in the mixture, and the cover section 76 is turned so that the ball 80 is at the maximum section of the counter sleeve. When the arm 67 is now pressed, two valves 81 are simultaneously opened in the same degree so that a mixture with equal amounts of both colors flows from the spreading device. The ratio between the two colors can be adjusted by turning the counter sleeve 69 and the cover section 76 in the same degree to the same direction. When a third primary color is desired in the mixture, the counter sleeve 69 is turned in relation to the cover section 76. Thus by turning the counter sleeve 69 and the cover section 76 and by pressing the operating arm 63, any color can be obtained from the spreading device as a mixture of the three primary colors. The force of the spring 68 is sufficient to return the turning arm 67 to the initial position, and so the spring must be able to press the setting ball 61 to the upper position by means of the ring 64 and the rod 71 against the spring 60, when the turning arm 67 is released. It is possible, of course, to include a thinner container and feeding of the thinner in this device. The ring 73 of the counter sleeve is preferably provided with a scale running in even steps from 0 to 90 so that 0 corresponds to the minimum section and 90 to the maximum section. This kind of scale will also show the size of the slope $\alpha$ of the counter surface 75 of the counter section 74.

FIG. 10 shows a further embodiment of a device for carrying out the method of this invention. Four containers 96, three for the primary colors and one for thinner, are fitted inside the frame 95 of the device. Each container 96 can be moved by means of an operating element 97 in the longitudinal direction of the frame. This operating element can be for instance a pressing lever, a springlike element of the like. The point of the frame part 95 is provided with a ball 98 which acts as a spreading element and to which colors and thinner can be led through flexible or, as is shown in FIG. 10, curved capillary tubes 99. Each capillary tube 99 is connected to a container by means of a tube or pipe 100, which is elastic in the longitudinal direction, such as rubber tubing. Inside each capillary tube 99 there is a flexible pin 101 extending to the ball 98 or close to the ball 98. A valve pin 103 is fitted around the pin 101 substantially at the point where the pin 101 enters the tube 100 from the capillary tube 99. The upper end of each capillary tube 99 is provided with a counter element for the valve pin 103, such as a valve plate 102, preferably made of resilient material, such as rubber. The valve pin 103 together with the corresponding valve plate 102 forms a control valve in each container, and this control valve controls the flow of colors or thinner into the spreading element 98. The pins 101 extend through the flexible tubes 100 up to the lower parts of the containers 96. At this point the upper end of the pin 101 is provided with an element, such as a transverse pinlike part 104 which is attached to a hole or the like in the lower part of the container 96. When the operating element 97 is pressed against the frame 95, the corresponding color or thinner container 96 moves upwards, away from the ball 98. When the container 96 moves, it pulls the pin 101 with it and opens the control valve 102, 103 by means of the movement of the pin 101. The more the operating element 97 is pressed, the more the control valve opens and the more color or thinner flows through the capillary tube to the spreading element 98.

Desired color is obtained simply by pressing the operating elements or levers 97 in suitable relations to each other as desired and adding thinner when necessary. The pin 101 extending in the capillary tubes close to the ball 98 keep the color ducts open, and they will not be damaged as the valves are opened by pulling the needles.

The device described above has a control element for each color and thinner, but it possible, of course, to use a control mechanism described in connection with FIGS. 5 to 9.

Colors and possibly thinner which have been led to the spreading element as described in connection with the above embodiments, are mixed on one hand in the spreading element itself, that is in the nib or its parts, or by means of a brush or a ball, and on the other hand on the spreading base, in the spreading point as a result of friction against the base. The advantage of this kind of mixing is the fast change by degrees or continuously from one color mixture and tone to another while it is not necessary to lift the spreading element off from the spreading base.

The method and device of this invention enables the artist to obtain desired color and tones from the spreading device by setting the setting sleeve by small finger movements while painting, drawing or tinting.

The device according to the invention can be provided with color markings so that all colors are obtained in the right tone even if the lighting conditions are not the same as in daylight, especially as some colors change the tone after drying and some colors have an initial gloss changing the tone, especially when tinting.

The invention is not restricted to the above embodiment but can considerably vary in details within the scope of the claims. The positioning of the pressing wedges affecting the adjustment cavities, or the corresponding pressing balls can vary if the cone surfaces of the setting sleeve are set in the corresponding way. The setting sleeve can be replaced by a piece provided with cone-like outer surfaces and movable in the longitudinal direction. The setting element 50 affecting the pressing elements can be replaced by levers, springs or the like for pressing the pressing elements in desired ratio by means of known mechanical operation principles.

We claim:

1. An apparatus for spreading colored fluids, comprising:

a. a frame;

b. a spreading element mounted with said frame for receiving and spreading fluids;

c. a plurality of fluid containers mounted with said frame for controllably supplying each of a plurality of fluids to said spreading element; and d. a plurality of adjustment ducts, each being made of an elastic material and being operably connected between each of said fluid containers and said spreading element, for controlling the number of said plurality of fluids supplied from said plurality of fluid containers to said spreading element, whereby a single fluid or a desired number of fluids are supplied to said spreading element for spreading the fluid or plurality of fluids;

e. pressing means for selectively pressing against any of said adjustment ducts to force fluid from said adjustment ducts to said spreading element, said pressing means including:

a plurality of pressing wedges pivotally mounted with said frame, each of said wedges having a wedge-shaped surface in contact with one of said plurality of adjustment ducts;

guide sleeve means extending around said pressing wedges and being mounted for longitudinal movement with respect to said frame, said guide sleeve means having a plurality of holes formed therein adjacent said pressing wedges; and pressing ball means mounted in said guide sleeve holes adjacent said wedges in contact with said fluid adjustment ducts for exerting a force on said fluid adjustment ducts through said pressing wedges contacting said pressing ball means in response to movement of said guide sleeve means; and f. setting sleeve means mounted for rotational and longitudinal movement with respect to said pressing means and having conical surfaces for operably engaging said pressing means to control which of said adjustment ducts said pressing means presses against an irrelative proportion of the fluids forced from said adjustment ducts to said spreading element, whereby two or more of said fluids are controllably fed into a desired ratio to said spreading element.

2. The structure set forth in claim 1, wherein said conical surfaces of said setting sleeve means include:

a cut, right conical surface at one interior end portion of said setting sleeve means;

a cut, oblique, conical surface at an interior end portion of said setting sleeve means opposite said interior end portion having said right conical surface; and said right conical surface and said oblique conical surface both having smaller radii towards the center of said setting sleeve means.

3. The structure set forth in claim 2, wherein:

said plurality of fluid containers include:

a plurality of color containers; and at least one thinner container;

said plurality of adjustment ducts include:

a plurality of color adjustment ducts, each being in fluid communication with one of said color containers; and at least one thinner adjustment duct in fluid communication with said thinner container; and said pressing means comprises:

pressing ball means mounted in said guide sleeve holes adjacent said wedges in contact with only said color adjustment ducts for exerting a force on said color adjustment ducts through said pressing wedges contacting said pressing ball means in response to movement of said guide sleeve means; and further including push arm means mounted with said pressing wedge in contact with said thinner adjustment duct for exerting a pressing force on said thinner adjustment duct through said push arm means.

4. The structure set forth in claim 3, where said pressing means includes:

a pressing lever having a pressing arm;

mounting means for pivotally mounting said guide sleeve means with a first portion of said pressing lever and for pivotally mounting said push arm means with a second portion of said pressing lever spaced from said first portion of said lever;

a plurality of teeth formed on said pressing lever and extending between said first and second portions of said pressing lever;

ratchet means for selectively and operably engaging any of said pressing lever teeth for forming a lever pivot support about which said pressing lever pivots in response to a force applied to said pressing arm, whereby selection of an appropriate lever pivot support permits movement of said guide sleeve means, said push arm means or both in response to a force applied to said pressing arm.

5. The structure set forth in claim 4, wherein:

said guide sleeve means includes first guide surfaces;

said setting sleeve means includes second guide surfaces contacting said first guide surfaces; and said first and second guide surfaces engage one another with tightness sufficient for causing said setting sleeve means to move with said guide sleeve means but permitting rotational and longitudinal movement of said setting sleeve means with respect to said guide sleeve means in response to a force applied to said setting sleeve means.

6. The structure set forth in claim 3, wherein:

said guide sleeve means includes first guide surfaces;

said setting sleeve means includes second guide surfaces contacting said first guide surfaces; and said first and second guide surfaces engage one another with tightness sufficient for causing said setting sleeve means to move with said guide sleeve means but permitting rotational and longitudinal movement of said setting sleeve means with respect to said guide sleeve means in response to a force applied to said setting sleeve means.

7. The structure set forth in claim 7 wherein:

said plurality of fluid containers include:

a plurality of color containers; and at least one thinner container;

said plurality of adjustment ducts include:

a plurality of color adjustment ducts, each being in fluid communication with one of said color containers; and at least one thinner adjustment duct in fluid communication with said thinner container; and said pressing means comprises:

pressing ball means mounted in said guide sleeve holes adjacent said wedges in contact with only said color adjustment ducts for exerting a force on said color adjustment ducts through said pressing wedges contacting said pressing ball means in response to movement of said guide sleeve means; and further including push arm means mounted with said pressing wedge in contact with said thinner adjustment duct for exerting a pressing force on said thinner adjustment duct through said push arm means.

8. The structure set forth in claim 7, wherein said pressing means includes:

a pressing lever having a pressing arm;

mounting means for pivotally mounting said guide sleeve means with a first portion of said pressing lever and for pivotally mounting said push arm means with a second portion of said pressing lever spaced from said first portion of said lever;

a plurality of teeth formed on said pressing lever and extending between said first and second portions of said pressing lever;

ratchet means for selectively and operably engaging any of said pressing lever teeth for forming a lever pivot support about which said pressing lever pivots in response to a force applied to said pressing arm, whereby selection of an appropriate lever pivot support permits movement of said guide sleeve means, said push arm means or both in response to a force applied to said pressing arm.

9. The structure set forth in claim 8, wherein:

said guide sleeve means includes first guide surfaces;

said setting sleeve means includes second guide surfaces contacting said first guide surfaces; and said first and second guide surfaces engage one another with tightness sufficient for causing said setting sleeve means to move with said guide sleeve means but permitting rotational and longitudinal movement of said setting sleeve means with respect to said guide sleeve means in response to a force applied to said setting sleeve means.

10. The structure set forth in claim 7, wherein:

said guide sleeve means includes first guide surfaces;

said setting sleeve means includes second guide surfaces contacting said first guide surfaces; and said first and second guide surfaces engage one another with tightness sufficient for causing said setting sleeve means to move with said guide sleeve means but permitting rotational and longitudinal movement of said setting sleeve means with respect to said guide sleeve means in response to a force applied to said setting sleeve means.

11. An apparatus for spreading colored fluids comprising:

a frame;

a spreading element mounted with said frame for receiving and spreading fluids;

a plurality of fluid containers mounted with said frame for controllably supplying each of a plurality of fluids to said spreading element; and control means operably connected between each of said fluid containers and said spreading element for controlling the number of said plurality of fluids supplied from said plurality of fluid containers to said spreading element, whereby a single fluid or a desired number of fluids are supplied to said spreading element for spreading the fluid or plurality of fluids, said control means includes:

duct means connecting each of said plurality of fluid containers to said spreading element;

a plurality of valves, each of said valves being mounted with the lower end of one of said fluid containers;

a plurality of capillary tubes, each of said capillary tubes extending upward from one of said valves to an upper part of its fluid container and returning to a lower part of said container; and valve control means for controlling each of said plurality of valves to regulate the flow of fluid from said fluid container to said spreading element.

12. The structure set forth in claim 11, wherein said valve control means includes:

a center tube mounted with said frame;

a setting ball mounted with said center tube for longitudinal movement with respect thereto;

a spring fitted around said center tube;

a setting lever for moving said setting ball longitudinally with respect to said center tube;

a counter sleeve rotatably mounted with said center tube beneath said setting ball and having a counter surface formed thereon;

a cover section mounted with said setting ball and having an arm formed therewith;

a cover section ball mounted with said cover section arm and in rolling engagement with said counter surface of said counter sleeve; and a plurality of valve closure balls in contact with an upper surface of said cover section, each of said valve closure balls being mounted with one of said valves for closing said valves in an upper position and opening said valves in an upper position and opening said valves in a lower position, whereby pressing said setting lever longitudinally displaces said setting ball and said cover section, and said cover section and said counter sleeve cooperatively regulate the horizontal orientation of said upper surface of said cover section for controllably opening selected valves with said valve closure balls.

13. The structure set forth in claim 12, wherein said counter surface of said counter sleeve includes:

a cone-like step surface surrounding said counter sleeve;

said step surface forming an angle of approximately 90° with longitudinal surface of said counter sleeve at a maximum section of said step surface;

said angle of said step surface decreasing linearly from said maximum section and forming a minimum section at which said step surface forms an angle of approximately 0° with said longitudinal counter sleeve surface so that said step surface substantially merges with said longitudinal counter sleeve surface at said minimum section.

14. The structure set forth in claim 13, wherein said control means includes:

a circular mounting member; and three valves mounted with said circular mounting member at a spacing of 120° from each other.

15. The structure set forth in claim 13, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

16. The structure set forth in claim 13, further including:

a scale mounted on the circumference of said counter sleeve, said scale having even spacings from 0 to 90 corresponding to the angle said step surface forms with said longitudinal counter sleeve surface.

17. The structure set forth in claim 16, wherein said control means includes:

a circular mounting member; and three valves mounted with said circular mounting member at a spacing of 120° from each other.

18. The structure set forth in claim 16, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

19. The structure set forth in claim 12, wherein said control means includes:

a circular mounting member; and three valves mounted with said circular mounting member at a spacing of 120° from each other.

20. The structure set forth in claim 12, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

21. The structure set forth in claim 12, wherein said setting lever includes:

a turning arm;

a mounting sleeve rigidly affixed to said center tube;

a ring section mounted with said turning arm and extending around said center tube; and a return spring mounted with said turning arm.

22. The structure set forth in claim 21, wherein said counter surface of said counter sleeve includes:

a cone-like step surface surrounding said counter sleeve;

said step surface forming an angle of approximately 90° with longitudinal surface of said counter sleeve at a maximum section of said step surface;

said angle of said step surface decreasing linearly from said maximum section and forming a minimum section at which said step surface forms an angle of approximately 0° with said longitudinal counter sleeve surface so that said step surface substantially merges with said longitudinal counter sleeve surface at said minimum section.

23. The structure set forth in claim 22, further including:

a scale mounted on the circumference of said counter sleeve, said scale having even spacings from 0 to 90 corresponding to the angle said step surface forms with said longitudinal counter sleeve surface.

24. The structure set forth in claim 21, wherein said control means includes:

a circular mounting member; and three valves mounted with said circular mounting member at a spacing of 120° from each other.

25. The structure set forth in claim 21, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

26. The structure set forth in claim 21, further including:

setting rod means adjacent said center tube and extending between said setting ball and an upper surface of said ring section for adjusting the movement of said setting ball.

27. The structure set forth in claim 26, wherein said control means includes:

a circular mounting member; and three valves mounted with said circular mounting member at a spacing of 120° from each other.

28. The structure set forth in claim 26, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

29. The structure set forth in claim 26, wherein said counter surface of said counter sleeve includes:

a cone-like step surface surrounding said counter sleeve;

said step surface forming an angle of approximately 90° with longitudinal surface of said counter sleeve at a maximum section of said step surface;

said angle of said step surface decreasing linearly from said maximum section and forming a minimum section at which said step surface forms an angle of approximately 0° with said longitudinal counter sleeve surface so that said step surface substantially merges with said longitudinal counter sleeve surface at said minimum section.

30. The structure set forth in claim 29, further including:

a scale mounted on the circumference of said counter sleeve, said scale having even spacings from 0 to 90 corresponding to the angle said step surface forms with said longitudinal counter sleeve surface.

31. The structure set forth in claim 11, wherein said control means includes:

a circular mounting member; and three valves mounted with said circular mounting member at a spacing of 120° from each other.

32. The structure set forth in claim 31, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

33. The structure set forth in claim 11, wherein each of said valves includes:

a tube guide;

a closure ball retractably engaging a lower end of said tube guide;

an elastic seal section mounted inside said tube guide above said closure ball; and spring means engaging said closure ball for pressing said closure ball downwards.

34. An apparatus for spreading colored fluids comprising:

a. a frame;

b. a spreading element mounted with said frame for receiving and spreading fluids;

c. a plurality of fluid containers mounted with said frame for controllably supplying each of a plurality of fluids to said spreading element;

d. control means operably connected between each of said fluid containers and said spreading element for controlling the number of said plurality of fluids supplied from said plurality of fluid containers to said spreading element, whereby a single fluid or a desired number of fluids are supplied to said spreading element for spreading the fluid or plurality of fluids, said control means including:

1. a plurality of elastic tubes, each of said plurality of tubes being connected to a lower part of one of said fluid containers;

2. a plurality of control valves, each being mounted in a lower section of one of said tubes;

3. a plurality of capillary tubes, each of said capillary tubes extending from one of said control valves to said spreading element; and

4. a plurality of pins, each of said pins being inside one of said capillary tubes to one of said fluid containers to control one of said control valves in response to longitudinal movement of said fluid container.

35. The structure set forth in claim 34, wherein said control means further includes:

a plurality of levers, each of said levers being mounted with one of said fluid containers for moving said fluid container away from said spreading element so that said control valve associated with said fluid container is opened and fluid from said fluid container flows to said spreading element.

* * * * *